United States Patent [19]

von Hein

[11] Patent Number: 5,007,891

[45] Date of Patent: Apr. 16, 1991

[54] DEVICE FOR PRODUCING AN ADDITIONAL FOLD IN FOLDING DEVICES OF ROTARY PRINTING PRESSES

[75] Inventor: Eduard von Hein, Bern, Switzerland

[73] Assignee: Maschinenfabrik Wifag, Bern, Switzerland

[21] Appl. No.: 427,463

[22] Filed: Oct. 25, 1989

[30] Foreign Application Priority Data

Oct. 28, 1988 [DE] Fed. Rep. of Germany ..... 3836342

[51] Int. Cl.[5] ..... B65H 45/16

[52] U.S. Cl. ..... 493/444; 493/471

[58] Field of Search ..... 493/356, 357, 358, 359, 493/423, 444, 445, 471

[56] References Cited

U.S. PATENT DOCUMENTS

| | | | |
|---|---|---|---|
| 308,214 | 11/1884 | Stonemetz | 493/445 |
| 1,120,771 | 12/1914 | Wagner et al. | 493/445 |
| 1,501,774 | 7/1924 | Heeter et al. | 493/444 |
| 1,581,677 | 4/1926 | Carnovsky | 493/444 |
| 1,693,147 | 11/1928 | King | 493/444 |
| 3,576,051 | 4/1971 | Click | 493/435 |
| 4,545,782 | 10/1985 | Niemiro et al. | 493/444 |
| 4,781,667 | 11/1988 | Kitai | 493/445 |

FOREIGN PATENT DOCUMENTS

| | | | |
|---|---|---|---|
| 2912839 | 10/1980 | Fed. Rep. of Germany | 493/445 |

*Primary Examiner*—William E. Terrell

*Attorney, Agent, or Firm*—McGlew & Tuttle

[57] ABSTRACT

A print copy folding device arrangement including a folding blade drum, a first folding roller, a second folding roller and a conveyor belt arrangement. The folding rollers include a first peripheral area segment having a surface extending about a first circumferential portion of said first roller, spaced from a central rotational axis a distance $r_1$ and a second peripheral area segment including a recessed peripheral surface, the recessed peripheral surface being spaced from the central rotational axis a distance r2 wherein $r_1 > r_2$ and having residual peripheral surfaces disposed at each side of the recess peripheral surface. The residual peripheral surfaces are spaced from the central rotational axis the distance $r_1$. A third peripheral area segment is provided extending about a third circumferential portion of rollers. The third peripheral area is provided with a recessed surface spaced from the central rotational axis the distance $r_2$.

7 Claims, 3 Drawing Sheets

DEVICE FOR PRODUCING AN ADDITIONAL FOLD IN FOLDING DEVICES OF ROTARY PRINTING PRESSES

FIELD OF THE INvENTION

The present invention pertains to a device for producing an additional fold for use in a folding devices of rotary printing presses.

BACKGROUND OF THE INVENTION

Folding devices of the above-described type are generally known. Folding is performed at full paper speed by means of a rotary folding blade that projects from the surface of a rotating drum, and the tip of said folding blade pushes the print copy or pack of print copies to be folded into two folding rollers rotating in opposite directions. Misfolding at high paper speeds is a disadvantage of these devices. This causes damage due to the whipping effect that occurs at the trailing ends of the print copies.

West German Offenlegungsschrift No. 28,46,191 discloses a process in which the packs of copies to be printed are distributed between two analogous folding devices, so that the folding speeds are cut in half, which is said to lead to a reduction of the whipping effect. However, a folding device based on this process is very expensive, because it requires two folding devices for the additional fold.

SUMMARY AND OBJECTS OF THE INVENTION

It is an object of the present invention to provide a folding device of the aforementioned type, in which the inevitable whipping effect on the trailing ends of the print copies can disappear spontaneously by fluttering, without damage to the print copies.

According to the invention, a print copy folding device arrangement is provided including a folding blade drum, first and second folding rollers and a conveyor belt system. The first folding roller and second folding roller cooperate to define a folding zone adjacent the folding blade drum. The first folding roller rotates in a direction opposite the direction of rotation of the second folding roller. The folding rollers are driven in cadence with the feed of print copies. At least one of the folding rollers includes a first peripheral area extending about a first circumferential portion of the roller and a second peripheral area extending about a second circumferential portion of the roller, the first peripheral area having a peripheral surface defining a folding zone forming the fold of the print copy. The second peripheral portion includes a recessed peripheral surface and side residual peripheral surfaces (the side residual surfaces forming an extension of the first peripheral area) disposed at sides of the recessed peripheral surface. The residual surfaces engage the print copy upon the further movement of the print copy (movement from the folding zone). The roller includes a third peripheral area positioned between the first and second peripheral areas. The third peripheral area extends about a third circumferential portion of the roller and has a peripheral surface which is completely recessed except for a belt guide. The conveyor belt system engages each of the rollers for removing the folded print copies from the folding zone.

It is particularly advantageous if the middle third of the length of the print copy is guided by residual surfaces that are left in place in the surface of the folding roller and additionally by a belt, without the middle part of the print copy being rolled between the folding rollers. This makes it possible to reach high folding speeds at a high quality of folding.

A further object of the invention is to provide a folding arrangement which is trouble free in use, simple in design and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
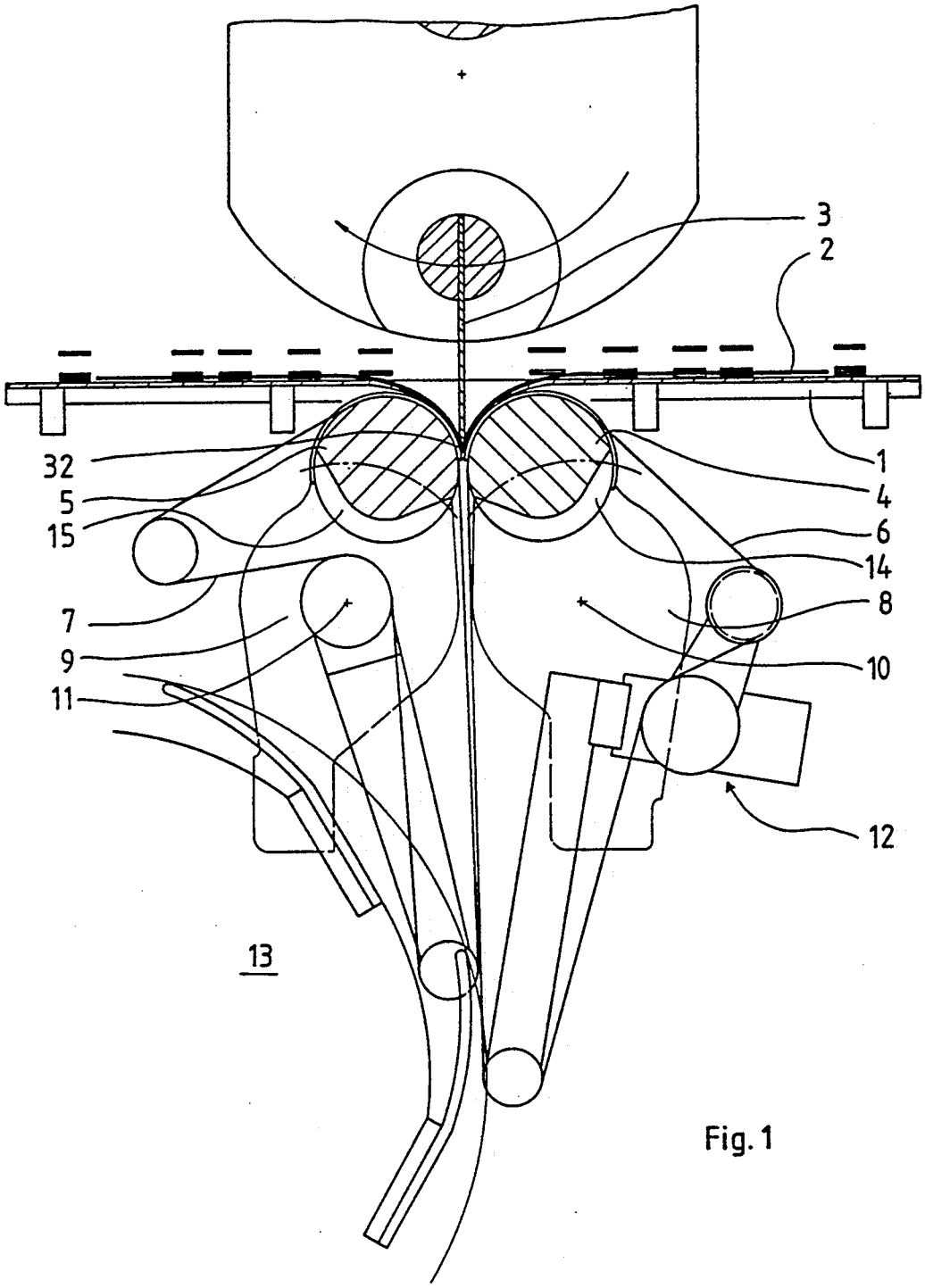
FIG. 1 is a sectional elevational view of the device at the beginning of the folding of the print copy.

Referring to the drawings in particular, the invention embodied therein includes a folding device arrangement, comprising a folding blade drum with folding blade 3, first folding roller 4 and second folding roller 5 which cooperate to define a folding zone. The first folding roller 4 rotates in a direction opposite to the direction of rotation of the second folding roller 5. The folding rollers are driven in cadence with the print copies 2. At least one of the first folding roller 4 and the second folding roller 5 (preferably both) include the first peripheral area 21 extending about first circumferential portion of the folding roller and a second peripheral area 24 extending about a second circumferential portion of the roller. The first peripheral area 21 has a peripheral surface which cooperates to define the folding zone for forming the fold of the print copy 2. The second peripheral portion 24 includes a recessed peripheral surface 25 and side residual peripheral surfaces 26 and 27 exposed at sides of the recessed peripheral surface 25. The side residual surfaces 26 and 27 may advantageously be at the same level as the surface of the first peripheral portion 21 for engaging the print copy upon movement of the print copy beyond the folding zone. A third peripheral area 31 is provided extending about a third circumferential portion of the roller. The third peripheral area 31 includes a peripheral surface which is completely recessed except for the belt guide portions 22 and 23. The arrangement includes a conveyor belt system with conveyor belts 6 and 7. The conveyor belts 6 and 7 engage each of the rollers for moving the folded print copies 2 from the folding zone.

The print copies 2 arriving according to FIG. 1 on a folding table 1 are pressed by the tip of folding blade 3 between the folding rollers 4 and 5. Folding rollers 4 and 5 are arranged asymmetrically and rotated in opposite directions in the known manner. Each of the folding rollers 4 and 5 drives a conveyer belt system 6, 7. The folding rollers 4 and 5 are rotatably mounted on a pair of swiveling levers 8 and 9, respectively. The swiveling levers 8 and 9 are mounted rotatably around fulcrum points 10 and 11, respectively. The folding gap or folding zone between the folding rollers 4 and 5 can be adjusted to the thickness of the print copy 2 to be folded by means of adjusting mechanisms 12 by rotating the swiveling levers 8 and 9.

The folding rollers 4, 5 grip the print copy 2 introduced by the folding blade 3 into the folding gap, form the fold 32, and feed the print copy 2 to the delivery wheel 13 by means of the conveyer belt system 6, 7.

Figure 2:
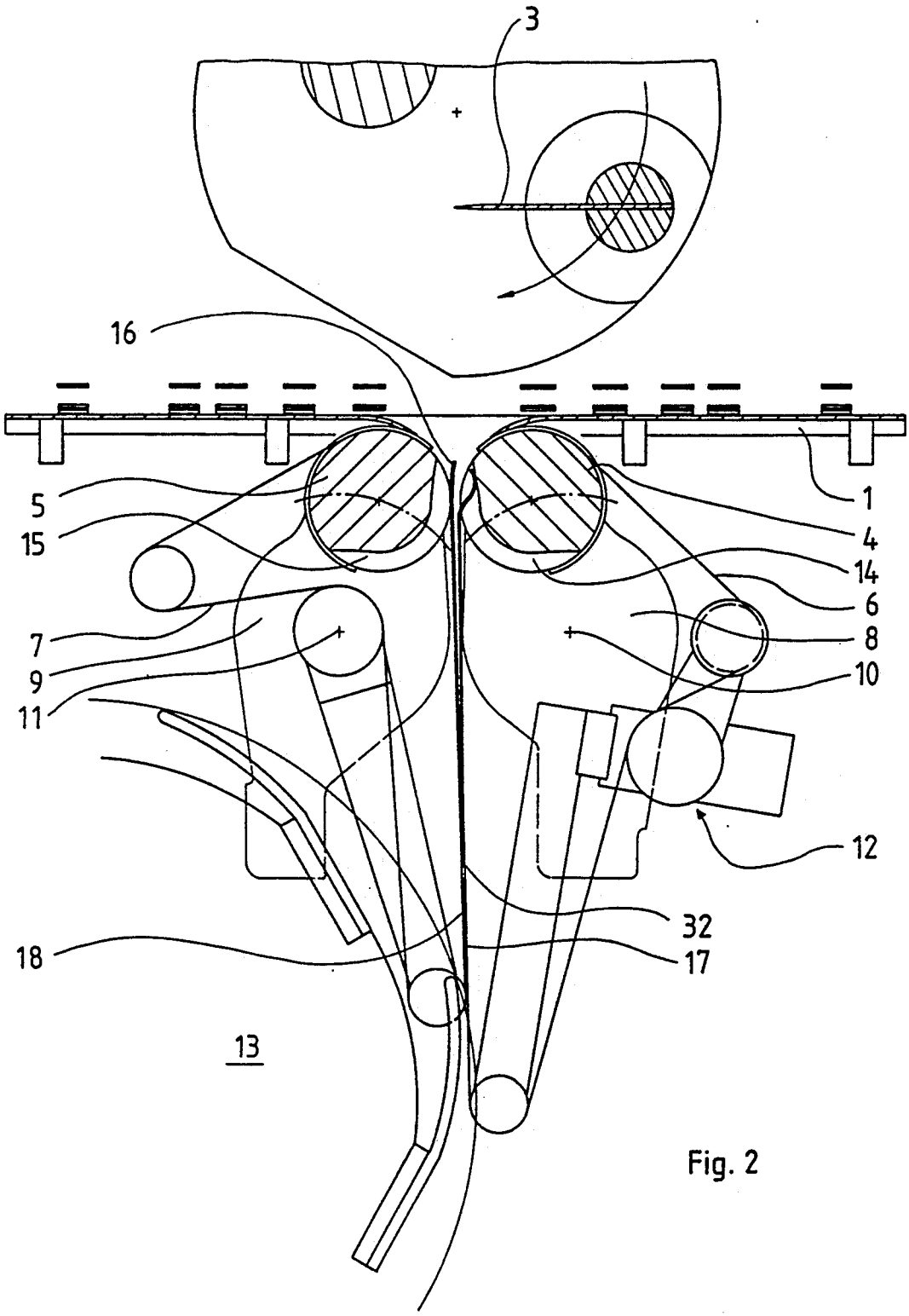
FIG. 2 is a sectional elevational of the device at the end of the folding of the print copy; and, FIG. 3 is a perspective view of a folding roller according to the invention.

As is shown in FIG. 2, the folding rollers 4 and 5 have recesses 14 and 15, respectively. The recesses 14 and 15 make it possible for the trailing end 16 of the print copy 2 to flutter out freely while the print copy 2 is being fed by the belts 17 and 18 of the conveyer belt system 6, 7 to the delivery wheel 13.

Figure 3:
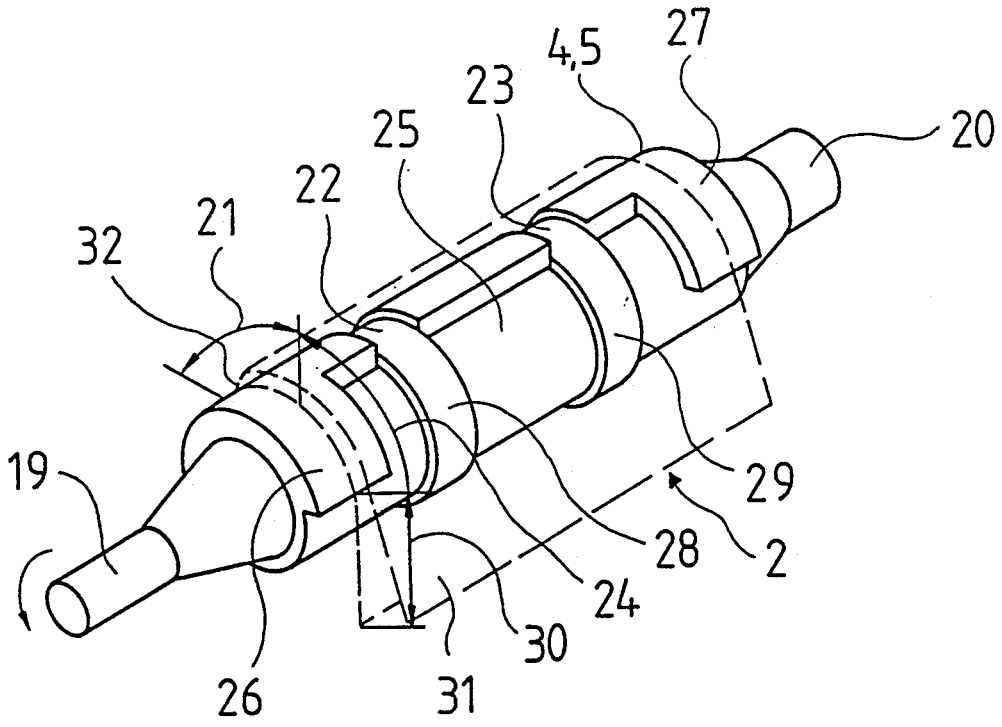

FIG. 3 shows schematically the design of the folding rollers 4 and 5. A print copy 2 is drawn for illustration in broken line to show the area of the print copy 2 which is in contact with the folding rollers 4 and 5. The folding rollers 4 and 5 are mounted with their axes 19 and 20, respectively, in the pairs of swiveling levers 8 and 9, respectively, so that they can be driven and rotated. The part 21 of the folding roller surface that forms the fold in the print copies 2 is continuous and has only cut recesses 22 and 23 for guiding the belts 17 and 18. The part 21 forming the fold in the print copy extends, in the direction of rolling, approximately over one third of the length of the print copy 2.

The area 24 joining the part 21 of the folding rollers 4 and 5 is provided with a recess 25, which is delimited by side or residual surfaces 26 and 27 to the left and right. The width of the recess 25 is dimensioned such that the print copy 2 comes into contact with the edge zones on the residual surfaces 26 and 27 on both sides. Guide rings 28, 29 for supporting the belts 17 and 18, respectively, are provided in the recess 25.

The length of the area 24 corresponds to approximately one third of the length of copy 2, i.e., the second third of the print copy covers the area 24 in the direction of rolling.

The last area 30 of the rollers 4 and 5, on which the end section 31 of the print copy will come to lie, is recessed over the entire breadth of rollers 4 and 5. Only the guide rings 28, 29 for supporting said belts 16 and 17, respectively, extend over the area 30.

The trailing end of the print copy is able to flutter out freely in said area 30. The folds produced by the whipping effect and the resulting fluttering of said print cop 2 will not be rolled in (pressed in), but they will be smoothed out during the further transport of said print copy 2, since these are held only by said belts 17 and 18.

While a specific embodiment of the invention has been shown and described in detail to illustrate the application of the principles of the invention, it will be understood that the invention may be embodied otherwise without departing from such principles.

What is claimed is:

1. A print copy folding device arrangement, comprising:

folding blade means;

first folding roller;

a second folding roller, said second folding roller rotating in a direction opposite to the direction of rotation of said first folding roller, said first folding roller and said second folding roller each having a central rotational axis and being driven in cadence with print copies, said first folding roller including a peripheral surface divided into three peripheral area segments sequentially arranged around the circumference of said first folding roller, including a first peripheral area having a surface extending about a first circumferential portion of said first roller, a second peripheral area including a recessed peripheral surface, said recessed peripheral surface being disposed radially inwardly with respect to said surface of said first peripheral area and having residual peripheral surfaces disposed at each side of said recessed peripheral surface, said residual peripheral surface forming a continuation of said surface of said first peripheral area, a third peripheral area extending about a third circumferential portion of said first roller, said third peripheral area having a recessed surface; and, conveyor belt means engaging each of said rollers for removing the folded print copies from the folding zone.

2. An arrangement according to claim 1, wherein said first peripheral area extends substantially over a third of the circumference of said first roller.

3. An arrangement according to claim 1, wherein said second peripheral area extends over a third of the circumference of said first roller.

4. An arrangement according to claim 1, wherein said residual surfaces, engage edge zones of the print copy.

5. An arrangement according to claim 1, wherein said residual surfaces are positioned to engage a middle zone of the print copy.

6. A print copy folding device arrangement, comprising:

a folding blade drum;

a first folding roller;

a second folding roller, said second folding roller rotating in a direction opposite to the direction of rotation of said first folding roller, said first folding roller and said second folding each having a central rotational axis and roller being driven in cadence with print copies, said first folding roller including a peripheral surface divided into three peripheral area segments sequentially arranged around the circumference of said first folding roller, including a first peripheral area segment having a surface extending about a first circumferential portion of said first roller spaced form said central rotational axis a distance $r_1$, a second peripheral area segment including a recessed peripheral surface, said recessed peripheral surface being spaced from said central rotational axis a distance $r_2$ wherein $r_1 > r_1$ and having residual peripheral surfaces disposed at each side of said recessed peripheral surface, said residual peripheral surfaces being spaced from said central rotational axis said distance $r_1$, a third peripheral area segment extending about a third circumferential portion of said first roller, said third peripheral area having a recessed surface spaced from said central rotational axis said distance $r_2$; and, conveyor belt means engaging each of said rollers for removing the folded print copies from the folding zone.

7. A print copy folding device arrangement, comprising:

folding blade means;

a first folding roller;

a second folding roller, said second folding roller rotating in a direction opposite to the direction of rotation of said first folding roller, said first folding roller and said second folding roller each having a central rotational axis and being rotationally driven in cadence with print copies, said first folding roller including a peripheral surface divided into three peripheral area segments sequentially arranged around the circumference of said first folding roller, including a first peripheral area segment having a surface extending about a first circumferential portion of said first roller, a second peripheral area segment including a recessed peripheral surface, said recessed peripheral surface being disposed radially inwardly with respect to said surface of said first peripheral area and having residual peripheral surfaces disposed at each side of said recessed peripheral surface, said residual peripheral surface forming a continuation of said surface of said first peripheral area, a third peripheral area segment extending about a third circumferential portion of said first roller, said third peripheral area having a recessed surface forming a continuation of said recessed peripheral surface;

a belt track formed in said first folding roller including a groove formed in said first peripheral area segment and a guide ring extending around said roller passing through said groove and through each of said peripheral area segments; and, conveyor belt means engaging each of said rollers including a conveyor belt supported by said guide ring for removing the folded print copies from the folding zone.

* * * * *